US006516957B1

(12) United States Patent
Harkinson

(10) Patent No.: US 6,516,957 B1
(45) Date of Patent: Feb. 11, 2003

(54) JOINTED CURTAIN ROD ASSEMBLY WITH RESILIENT CONNECTOR

(76) Inventor: Greg Harkinson, 12121 Veterans Memorial Dr., Suite 2, Houston, TX (US) 77067

( * ) Notice: Subject to any disclaimer, the term of this patent is extended or adjusted under 35 U.S.C. 154(b) by 0 days.

(21) Appl. No.: 09/611,554

(22) Filed: Jul. 7, 2000

(51) Int. Cl.[7] ..... A47F 5/00

(52) U.S. Cl. ..... 211/105.1; 211/123; 211/105.2; 403/291; 403/292

(58) Field of Search ..... 211/123, 105.1, 211/105.6, 105.2; 403/291, 292, 296

(56) References Cited

U.S. PATENT DOCUMENTS

| | | | | |
|---|---|---|---|---|
| 1,819,965 | A | * | 8/1931 | Norling |
| 2,474,690 | A | * | 6/1949 | Robinson et al. |
| 3,979,120 | A | * | 9/1976 | Dietrich |
| 3,999,730 | A | * | 12/1976 | Gonsalves et al. |
| 4,332,399 | A | * | 6/1982 | Kepple |
| 4,603,904 | A | * | 8/1986 | Tolleson et al. ..... 403/291 X |
| 5,018,626 | A | * | 5/1991 | Johnson ..... 211/105.1 |
| 5,112,157 | A | * | 5/1992 | Haarer ..... 403/292 |
| 5,263,594 | A | * | 11/1993 | Bianchi ..... 211/105.2 |
| 5,320,404 | A | * | 6/1994 | Le Gal |
| 5,445,471 | A | * | 8/1995 | Wexler et al. ..... 403/291 X |

* cited by examiner

*Primary Examiner*—Robert W. Gibson, Jr.
(74) *Attorney, Agent, or Firm*—Kenneth A. Roddy

(57) ABSTRACT

A curtain or drapery rod assembly has adjacent elongate rod sections joined end to end by a resilient connector for installation in angularly disposed relation around a corner between adjacent flat walls, such as in bay windows and corners of a room. In a preferred embodiment, the connector is a helical coiled spring having a first end connected in a first tubular rod section open end, an opposed second end connected in a second tubular rod section open end, and an intermediate portion disposed between the rod sections that forms a smooth curved transition adjacent to an angular corner when the first and second rod sections are supported in angularly opposed facing relation on respective first and second flat walls adjoining the angular corner. One end of the spring may be fixed in the open end of the first rod section and its opposed end frictionally engaged in the open end of the second rod section, or the helical coils at each end of the spring may be engaged on a pin extending transversely through the respective open ends of the rod sections to rotate relative to the pin members so that the length of the intermediate portion of the spring and distance between the rod ends is selectively adjusted by relative rotation to advance or retract the respective rod sections along the length of the spring as necessary to properly conform to the adjacent walls and corner angles of the particular installation. In an embodiment for solid rods, each end of the spring is threadedly connected to the spaced apart ends of the first and second rod sections.

13 Claims, 2 Drawing Sheets

JOINTED CURTAIN ROD ASSEMBLY WITH RESILIENT CONNECTOR

BACKGROUND OF THE INVENTION

1. Field of the Invention

This invention relates generally to the field of curtain rods, and more particularly to a jointed curtain rod assembly and resilient connector that allows the curtain rod sections to be installed in angularly disposed relation around a corner and also allows adjustability of the length of the joined curtain rod sections.

2. Brief Description of the Prior Art

Drapery rods are commonly formed in one-piece construction or telescoping rod sections. In the past, if a curtain rod was to be installed to span a corner between flat walls, such as in a bay window or corner of a room, it was necessary to preshape the curtain rod, or to provide rigid connectors between adjacent rod sections that had a fixed angular configuration. The preformed rod required precise measurements and calculations and frequently the preformed rod would not fit properly. If the location of the bend in the rod was incorrect, the length of the laterally extending rod sections could be too short or too long relative to the adjacent walls. If the angle of the bend was incorrect, the laterally extending rod sections would not be parallel with the adjacent walls.

Even with fixed angular connectors, the laterally extending rod sections are not always parallel with the adjacent walls, because the actual angle between adjacent flat walls is often not a true angle due to imprecise sheetrock and framing construction of the walls.

There are several patents that disclose various curtain rods and connectors for connecting sections thereof for installation around a corner between flat walls of a room and in bay windows. etc.

Haarer, U.S. Pat. No. 5,112,157 discloses a flexible connector for connecting one section of a curtain rod to another section of a curtain rod and for forming an angularly adjustable transition corner between the two sections. The connector includes end portions with snap locks for locking the connection between the connector and the two curtain rod sections and flanges for providing a stop to the telescopic advancement of the connector towards the rod sections beyond a predetermined point and vice versa. Thus, although the angular disposition of the rod sections can be adjusted, there is no provision for adjusting the length of the joined curtain rod sections.

Bianchi, U.S. Pat. No. 5,263,594 discloses a section bar for supporting curtains, constituted by at least two portions of section bar united to each other by a juncture element and having a hollow, contoured cross-section with a longitudinal side groove from which sliding support elements for curtain portions protrude. The juncture element has end portions which are slid into the section bar and a middle portion which is provided, in regions thereof which are opposite to the sides of said longitudinal groove, with a plurality of variously shaped partial-notch-slots, such as to enable the juncture element to be bent according to any desired angles. The juncture element preferably includes, within its body, rigid elements capable of being bent together with the body.

Rosenbaum, U.S. Pat. Nos. 2,790,558 and 2,890,799 disclose traverse rods of rectangular cross section channel construction having a plurality of longitudinally spaced transverse slots along its length extending through at least three walls of the channel construction that allow the rectangular traverse rod to be bent in a horizontal plane. A stiffening member is installed inside the rod to reinforce it since the plurality of slots weaken the structure and would otherwise allow the rod to sag under the load of a heavy curtain or drape.

Norling, U.S. Pat. No. 1,819,965 discloses a rod for door and window curtains that participates in movement of the door or window without changing its position in relation to the door or window. A longer rod section is fixed to the to the door by a bracket to move therewith and a shorter rod section hingedly connected to the longer rod is slidably mounted on a bracket fixed to the wall adjacent to the door frame with the hinged connection situated above the door hinge. In one embodiment, the hinge connector is a covered helical spring having opposed ends secured in the facing ends of the rods such that when the door is opened the longer rod moves pivotally with the door and the shorter rod section slides axially in its bracket relative to the wall. There is no provision for adjusting the length of the joined curtain rod sections.

The present invention is distinguished over the prior art in general, and these patents in particular by a curtain or drapery rod assembly having adjacent elongate rod sections joined end to end by a resilient connector for installation in angularly disposed relation around a corner between adjacent flat walls, such as in bay windows and corners of a room. In a preferred embodiment, the connector is a helical coiled spring having a first end connected in a first tubular rod section open end, an opposed second end connected in a second tubular rod section open end, and an intermediate portion disposed between the rod sections that forms a smooth curved transition adjacent to an angular corner when the first and second rod sections are supported in angularly opposed facing relation on respective first and second flat walls adjoining the angular corner. One end of the spring may be fixed in the open end of the first rod section and its opposed end frictionally engaged in the open end of the second rod section, or the helical coils at each end of the spring may be engaged on a pin extending transversely through the respective open ends of the rod sections to rotate relative to the pin members so that the length of the intermediate portion of the spring and distance between the rod ends is selectively adjusted by relative rotation to advance or retract the respective rod sections along the length of the spring as necessary to properly conform to the adjacent walls and corner angles of the particular installation. In an embodiment for solid rods, each end of the spring is threadedly connected to the spaced apart ends of the first and second rod sections.

SUMMARY OF THE INVENTION

It is therefore an object of the present invention to provide a curtain or drapery rod that may be easily installed around or in a corner between flat walls of a room, in bay windows, and the like, at the installation site without requiring preshaping or special tools.

It is another object of this invention to provide a curtain or drapery rod having adjacent rod sections joined by a resilient connector for forming an angularly adjustable transition corner between two adjacent sections.

Another object of this invention is to provide a curtain or drapery rod having adjacent rod sections joined by a resilient connector that may be installed around or in a corner between flat walls of a room, in bay windows and the like, which will allow adjacent rod sections to be adjusted longitudinally relative to the connector and adjacent wall surfaces.

Another object of this invention is to provide a curtain or drapery rod having adjacent rod sections joined by a resilient connector that may be installed around or in a corner between flat walls of a room, in bay windows and the like, which will allow adjacent rod sections to be positioned parallel with adjacent wall surfaces.

A further object of this invention is to provide a resilient connector for joining adjacent elongate tubular curtain or drapery rod sections together to span an angular corner between flat walls, such as in bay windows and corners of a room.

A still further object of this invention is to provide a curtain drapery rod and connector for connecting sections thereof which is simple in construction and inexpensive to manufacture.

Other objects of the invention will become apparent from time to time throughout the specification and claims as hereinafter related.

The above noted objects and other objects of the invention are accomplished by a curtain or drapery rod assembly having adjacent elongate rod sections joined end to end by a resilient connector for installation in angularly disposed relation around or in a corner between adjacent flat walls, such as in bay windows and corners of a room. In a preferred embodiment, the connector is a helical coiled spring having a first end connected in a first tubular rod section open end, an opposed second end connected in a second tubular rod section open end, and an intermediate portion disposed between the rod sections that forms a smooth curved transition adjacent to an angular corner when the first and second rod sections are supported in angularly opposed facing relation on respective first and second flat walls adjoining the angular corner. One end of the spring may be fixed in the open end of the first rod section and its opposed end frictionally engaged in the open end of the second rod section, or the helical coils at each end of the spring may be engaged on a pin extending transversely through the respective open ends of the rod sections to rotate relative to the pin members so that the length of the intermediate portion of the spring and distance between the rod ends is selectively adjusted by relative rotation to advance or retract the respective rod sections along the length of the spring as necessary to properly conform to the adjacent walls and corner angles of the particular installation. In an embodiment for solid rods, each end of the spring is threadedly connected to the spaced apart ends of the first and second rod sections.

DESCRIPTION OF THE PREFERRED EMBODIMENTS

Figure 1:
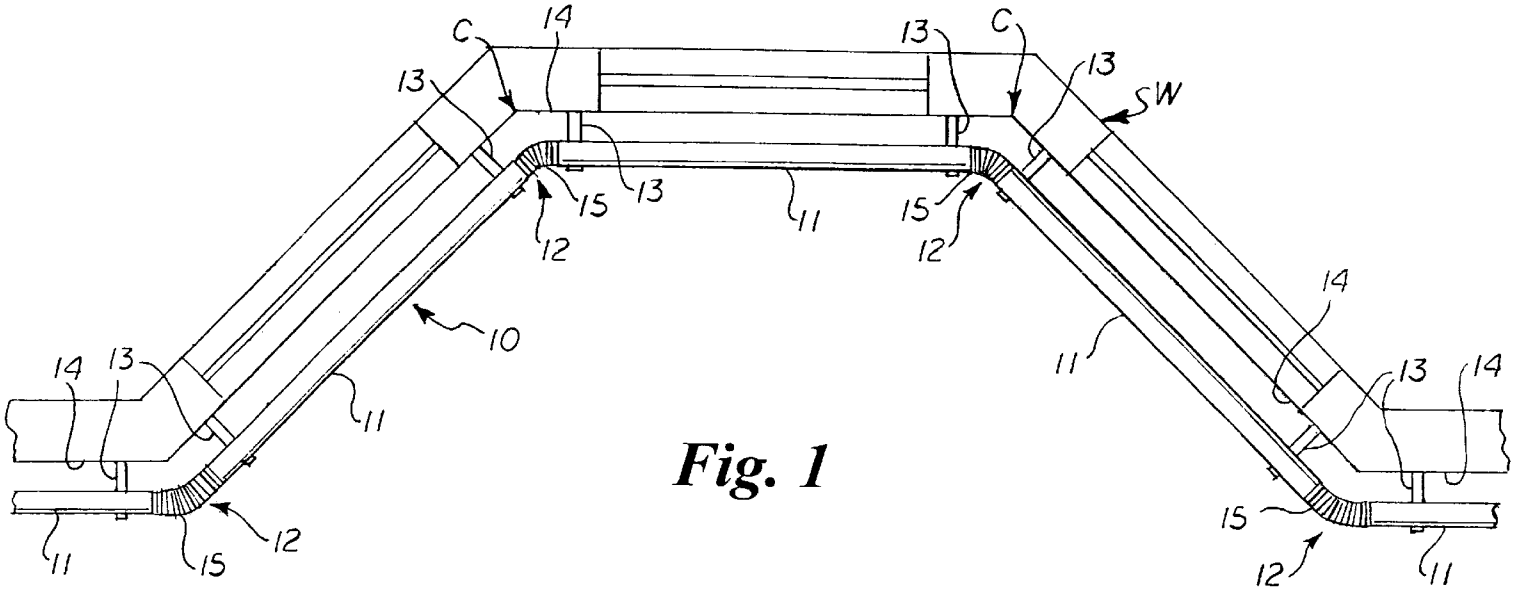
FIG. 1 is a top plan view of a bay window with a curtain or drapery rod assembly having sections joined by a resilient connector in accordance with the present invention installed therein.
Figure 2:
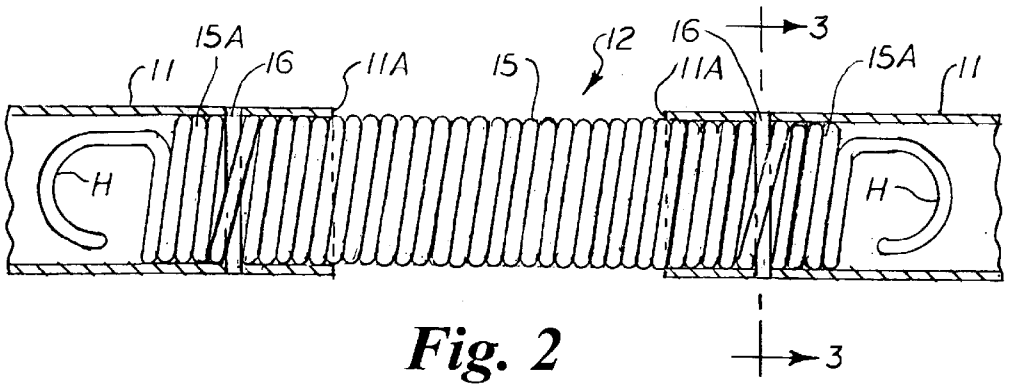
FIG. 2 is a longitudinal cross section through facing end portions of adjacent curtain or drapery rod sections joined by the resilient connector.

Referring to the drawings by numerals of reference, there is shown in FIG. 1, a curtain or drapery rod assembly 10 having adjacent rod sections 11 joined by a connector 12 in accordance with the present invention installed in a bay window W. FIG. 2 shows facing end portions 11A of adjacent curtain or drapery rod sections joined by a first embodiment of the resilient connector 12. The rod sections 11 are typically hollow tubular members having a circular cross section and are supported on brackets 13 secured above the window and to adjacent walls 14.

In the embodiment of FIG. 2, the resilient connector 12 is a helical coiled spring 15 having an outer diameter that is slightly less than the interior diameter of the rod sections 11. The opposed ends 15A of the spring connector 15 are received in the opposed open end portions of the adjacent facing rod sections 11. In a preferred embodiment, one end of the spring connector 15 is secured in one end of a hollow tubular rod section 11 by epoxy or other suitable means and the opposite end of the spring connector is frictionally engaged in the inside diameter of the adjacent tubular rod section. It should be understood that both ends 15A of the spring connector 15 may be frictionally engaged in the open ends of the hollow tubular rod sections 11.

Figure 3:
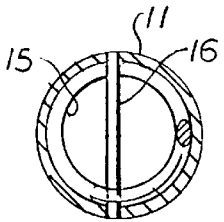
FIG. 3 is a transverse cross section through one end portion of a curtain or drapery rod section taken along line 3—3 of FIG. 2, showing the resilient connector secured therein by the rod or pin.

Alternatively, as seen in FIGS. 2 and 3, a pin 16 may be installed transversely through the opposite ends of each hollow tubular rod section 11 and the opposed ends 15A of the spring connector 15 are slidably received in the ends of the hollow tubular members 11 and adjustably engaged on the respective pins 16. The opposed ends 15A of each connector 15 are adjustably engaged on the respective pin 16 by placing the outermost coil at the end of the coiled spring connector over the pin 16 and then rotating the curtain or drapery rod 11 relative to the connector, or vice versa, until a sufficient number of the coils at each end of the connector are disposed in the rod inwardly of the of the pin to join the rod ends and connector together. The distance between the opposed facing ends 11A of the rod sections 11, and thus the length of the exposed portion of the spring connector 15, can be adjusted by further relative rotation to advance or retract the respective rod ends along the length of the spring connector.

This adjustment feature also allows the curtain or drapery rod sections 11 to be provided in approximate lengths for the particular window size and wall area to be spanned and then to be further adjusted at the site of installation to lengthen or shorten the length of the assembly or sections thereof relative to the walls 11 and corner angles to precisely conform to the particular installation.

As shown in FIG. 1, when the assembly 10 is installed, the exposed portion of the resilient connector 12,15 provides a smooth curved transition between inside and/or outside corners C of the window configuration W which may be an obtuse angle, an acute angle, a right angle, or combinations thereof and angles of any degree. The coiled spring connector 15 also allows the adjacent rod sections 11 to be accurately positioned parallel with the adjacent wall surfaces 14 even if the actual angle between the adjacent flat walls is not a true angle due to imprecise sheetrock and wall framing construction. In some installations, the curtain or drapery rod sections 11 and coiled spring connectors 15 are covered by the curtain or drapery material or by a valance so that the connector is not seen.

Figure 4:
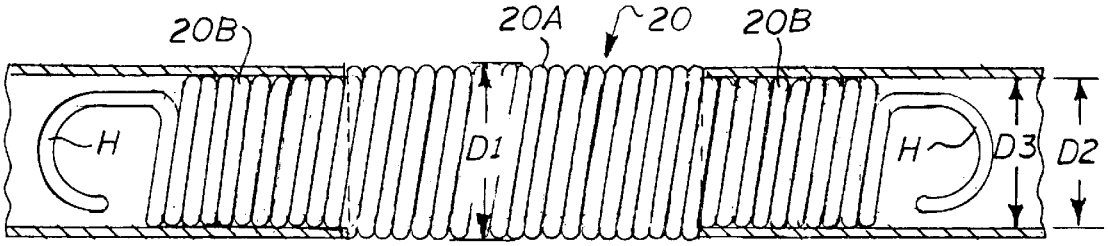
FIG. 4 is a side elevation view of a modification of the resilient connector having reduced diameter end portions.

It should be understood that the outer ends 11A of the hollow tubular rods 11 may be beveled or cut at an angle to provide a more precise angled connection between adjacent rod sections. In this modification only a very small portion, or none, of the coiled portion of the spring connector would be exposed. This allows curtain rings to slide around the angled connection without getting hung on the coils of the spring while still allowing slight adjustment to compensate for irregularities in the angles of the wall construction. FIG. 4 is a side elevation of a modified embodiment of the resilient helical coiled spring connector 20, similar to the previously described embodiment. In this modification, the helical coiled spring connector 20 has a midsection 20A with an outer diameter D1 approximately the same as the outer diameter D2 of the hollow tubular curtain or drapery rod sections 11 and has reduced diameter portions 20B at each end which are slightly less than the interior diameter D3 of the rod sections. The opposed reduced diameter ends 20B of the spring connector 20 are received in the open ends of the rod sections. One reduced diameter end 20B may be secured inside one end of the rod section by epoxy and its opposed end frictionally engaged inside the adjacent rod section, or one or both reduced diameter ends 20B may be adjustably engaged with pins 16 in the outer end portions of the adjacent facing rod sections, as described previously.

It should be noted that the spring connectors 15 and 20 described above are shown with ears or hooks H formed at their outer ends. The preferred spring connectors 15 and 20 are painted or provided with an outer coating, and the hooks H facilitate application of the paint or outer coating. This is accomplished by placing the hooks H on a jig or fixture with the spring connector 15,20 in a stretched condition and applying the paint or coating so as to coat the coils evenly and completely and allowing the paint or coating to dry or cure. This prevents the paint or coating from sticking the coils together. It should be understood that the hooks H may also be cut off after the spring connector has been painted or coated.

Figure 5:
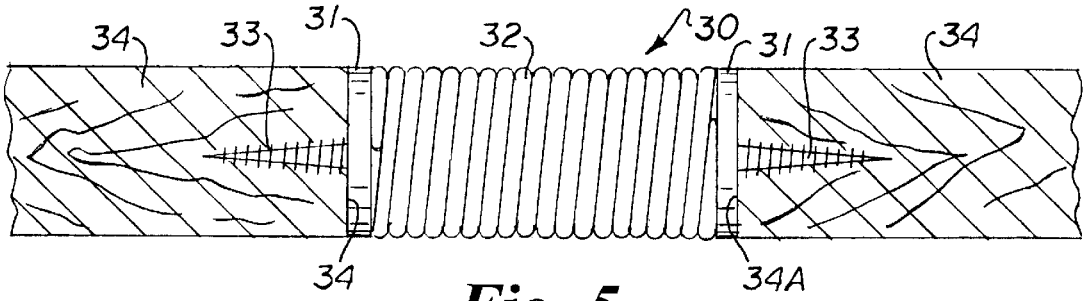
FIG. 5 is a side elevation view of an embodiment of the resilient coiled spring connector which is used to connect solid wooden curtain or drapery rods.

FIG. 5 shows another modification of the resilient coiled spring connector 30 which is used to connect solid wooden curtain or drapery rods. In this embodiment the a circular flat disk 31 is secured on each opposite end of the coiled spring 32 by conventional means such as welding or epoxy. One end of a threaded shank 33 is secured to the center of each disk 31 with the threaded portion extending outwardly therefrom. The ends of adjacent solid wooden curtain or drapery rods 34 are connected by threadedly engaging the shanks 33 in the ends 34A of the adjacent facing rod sections 34 similar to a wood screw.

Figure 6:
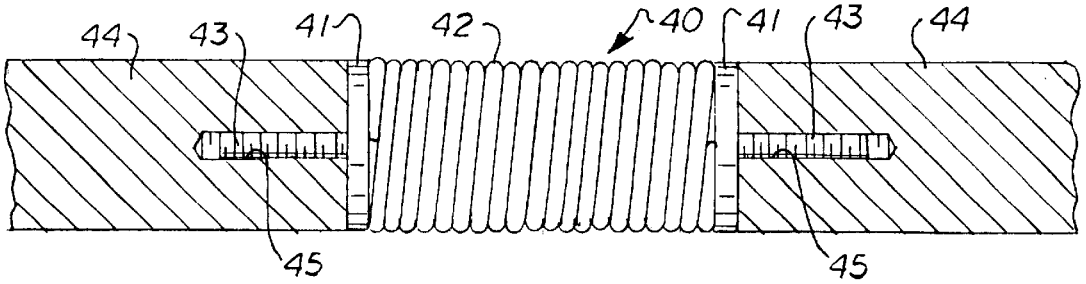
FIG. 6 is a side elevation view of another embodiment of the resilient coiled spring connector which is used to connect solid metal curtain or drapery rods.

FIG. 6 shows another modification of the resilient coiled spring connector 40 which is used to connect solid metal curtain or drapery rods. In this embodiment a circular flat disk 41 is secured on each opposite end of the coiled spring 42 by conventional means such as welding or epoxy. One end of a threaded shank 43 is secured to the center of each disk 41 with the threaded portion extending outwardly therefrom. The opposite ends of the solid metal rods 44 are provided with a central threaded bore 45 and the ends of adjacent rods are connected by threadedly engaging the shanks 43 in the threaded bores 45 at the ends of the adjacent facing rod sections 44.

Figure 7:
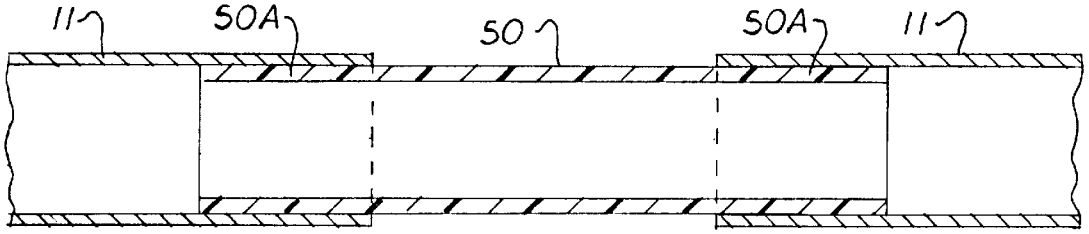
FIG. 7 is a side elevation view of a tubular elastomeric embodiment of the resilient curtain or drapery rod connector.

FIG. 7 is a side elevation view of a tubular elastomeric embodiment of the resilient curtain or drapery rod connector 50 for hollow tubular rods. In this embodiment, the connector 50 is formed of a tubular length of elastomeric material. The diameter of the outer ends 50A of the connector 50 are slightly less than the interior diameter of the rod sections 11 to be frictionally engaged in the open ends of the adjacent facing rod sections 11. One end of the connector 50 may be secured in one end of a hollow tubular rod section 11 by epoxy or other suitable means and the opposite end of the connector frictionally engaged in the inside diameter of the adjacent tubular rod section.

While this invention has been described fully and completely with special emphasis upon preferred embodiments, it should be understood that within the scope of the appended claims the invention may be practiced otherwise than as specifically described herein.

What is claimed is:

1. A curtain or drapery rod assembly having at least two adjacent elongate rod sections joined together by a resilient connector for installation in angularly disposed relation around or in a corner between adjacent flat walls, comprising:

a first elongate hollow tubular rod section having opposed first and second open ends and an adjacent second elongate hollow tubular rod section having opposed first and second open ends; and a resilient helical coiled spring connector having a first end frictionally engaged in said first rod section first open end and a second end frictionally engaged in said second rod section second open end to join said first open end of said first rod section and said second open end of said second rod section together in opposed spaced apart relation, and having an intermediate coiled portion disposed between said spaced apart ends of said first and second rod sections to form a smooth curved transition adjacent to an angular corner defined between angularly adjoining flat walls when said first and said second tubular rod sections are supported on respective said adjoining flat walls.

2. The curtain or drapery rod assembly according to claim 1, wherein said first end of said helical coiled spring is permanently secured in the interior of said first open end of said first tubular rod section and said second end of said helical coiled spring is frictionally and removably engaged in the interior of said second open end of said second tubular rod section.

3. The curtain or drapery rod assembly according to claim 1, further comprising:

engagement means in said first rod section first open end and said second rod section second open end for engaging said coiled spring first and second ends, respectively.

4. The curtain or drapery rod assembly according to claim 3, wherein said engagement means comprises a first pin member extending transversely through said first open end of said first tubular rod section and a second pin member extending transversely through said second open end of said second tubular rod section, with said first and second pins engaged with helical coils at said coiled spring first second ends, respectively.

5. The curtain or drapery rod assembly according to claim 4, wherein each said pin member is engaged between helical coils at said coiled spring first second ends to allow the distance between the said opposed facing first and second open ends of said first and second rod sections and the length of said spring intermediate portion to be selectively adjusted by relative rotation between said first and second rod sections and said coiled spring so as to advance or retract the respective said open ends along the length of said coiled spring.

6. The curtain or drapery rod assembly according to claim 1, wherein said intermediate coiled portion has a diameter approximately equal to the outer diameter of said first and second rod sections.

7. A curtain or drapery rod having a resilient connector at one end adapted to be to joined to an end of a similar adjacent spaced apart second curtain or drapery rod oriented at an angle relative thereto to span a corner between angularly adjacent flat walls, comprising:

a first elongate hollow tubular curtain or drapery rod having opposed first and second open ends; and a resilient helical coiled spring connector having a first end frictionally engaged in said first open end of said first rod, an intermediate coiled portion, and an opposed second end extending outwardly therefrom;

said connector second end sized to be frictionally and removably engaged in an open end of the adjacent spaced apart elongate hollow tubular curtain or drapery rod disposed in an angular orientation relative thereto to join said first and second rods together, with said intermediate coiled portion disposed in a smooth curve between said spaced apart ends of said angularly oriented first and second rods.

8. The curtain or drapery rod according to claim 7, wherein said first end of said helical coiled spring is frictionally and permanently secured in the interior of said first open end of said first tubular rod section and said second end of said helical coiled spring is sized to be frictionally and removably engaged in the interior of said open end of said second tubular rod.

9. The curtain or drapery rod according to claim 7, wherein said first end of said coiled spring is frictionally engaged and pinned in said first open end of said first tubular rod section by a first pin member extending transversely through said first open end of said first tubular rod section; and said second end of said coiled spring is adapted to be received and engaged on a second pin extending transversely through said [second] open end of said second tubular rod section.

10. The curtain or drapery rod according to claim 9, wherein helical coils of said coiled spring first and second ends are engaged with said first and second pins to allow the distance between the said spaced apart open ends of said first and second rod sections and the length of said spring intermediate portion to be selectively adjusted by relative rotation between said first and second rod sections and said coiled spring so as to advance or retract the respective said open ends along the length of said coiled spring.

11. A resilient connector for joining adjacent elongate curtain or drapery rod sections together to span an angular corner between flat walls, such as in bay windows and corners of a room, comprising:

a resilient helical coiled spring connector having a first end sized to be frictionally engaged in a first open end of a first elongate hollow tubular curtain or drapery rod section and a second end sized to be frictionally engaged in a second open end of a second elongate hollow tubular curtain or drapery rod section to join said first and second rod sections together, and having an intermediate coiled portion disposed between said first and second rod section ends when connected together;

said intermediate coiled portion forming a smooth curved transition adjacent to an angular corner when said first and said second elongate tubular rod sections are supported in angularly opposed facing spaced apart relation on respective first and second flat walls adjoining said angular corner.

12. The resilient connector according to claim 11, wherein said coiled spring first and second ends have helical coils sized and spaced to receive and engage a pin member extending transversely through said first open end and said second open end of said first and said second tubular rod sections, respectively; and to rotate relative to said pin member on which they are engaged so that the length of said spring intermediate portion is adjusted by relative rotation between said first and second rod sections and said coiled spring to advance or retract the opposed facing said open ends along the length of said coiled spring.

13. The resilient connector according to claim 11, wherein said helical coiled spring intermediate portion has a diameter approximately equal to the outer diameter of said first and second rod sections.

* * * * *